US009622011B2

(12) United States Patent
Seefeldt

(10) Patent No.: US 9,622,011 B2
(45) Date of Patent: Apr. 11, 2017

(54) VIRTUAL RENDERING OF OBJECT-BASED AUDIO

(71) Applicant: DOLBY LABORATORIES LICENSING CORPORATION, San Francisco, CA (US)

(72) Inventor: Alan J. Seefeldt, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 135 days.

(21) Appl. No.: 14/422,033

(22) PCT Filed: Aug. 20, 2013

(86) PCT No.: PCT/US2013/055841
§ 371 (c)(1),
(2) Date: Feb. 17, 2015

(87) PCT Pub. No.: WO2014/035728
PCT Pub. Date: Mar. 6, 2014

(65) Prior Publication Data

US 2015/0245157 A1 Aug. 27, 2015

Related U.S. Application Data

(60) Provisional application No. 61/695,944, filed on Aug. 31, 2012.

(51) Int. Cl.
*H04S 7/00* (2006.01)
*H04R 3/00* (2006.01)
(Continued)

(52) U.S. Cl.
CPC ..... *H04S 7/30* (2013.01); *H04R 3/002* (2013.01); *H04R 5/02* (2013.01); *H04S 7/307* (2013.01); *H04S 3/002* (2013.01); *H04S 2420/01* (2013.01)

(58) Field of Classification Search
None
See application file for complete search history.

(56) References Cited

U.S. PATENT DOCUMENTS 5,917,916 A 6/1999 Sibbald
6,442,277 B1 8/2002 Lueck
(Continued)

FOREIGN PATENT DOCUMENTS

CN 1114817 1/1996
DE 2941692 4/1981
(Continued)

OTHER PUBLICATIONS

Avizienis, R. et al "A Compact 120 Independent Element Spherical Loudspeaker Array with Programmable Radiation Patterns" 120th AES Convention, Paris, France, May 20-23, 2006, pp. 1-7.
(Continued)

*Primary Examiner* — Curtis Kuntz
*Assistant Examiner* — Qin Zhu

(57) ABSTRACT

Embodiments are described for a system for virtual rendering of object based audio through binaural rendering of each object followed by panning of the resulting stereo binaural signal between a plurality of cross-talk cancelation circuits feeding a corresponding plurality of speaker pairs. In comparison to prior art virtual rendering utilizing a single pair of speakers, the described embodiments improve the spatial impression for both listeners inside and outside of the cross-talk canceller sweet spot. Also described is an improved equalization technique for a crosstalk canceller that is computed from both the crosstalk canceller filters and the binaural filters and applied to a monophonic audio signal being virtualized. The described techniques improve timbre
(Continued)

300 for listeners outside of the sweet-spot as well as a smaller timbre shift when switching from standard rendering to virtual rendering.

15 Claims, 9 Drawing Sheets

(51) Int. Cl.
*H04R 5/02* (2006.01)
*H04S 3/00* (2006.01)

(56) References Cited

U.S. PATENT DOCUMENTS

| | | | | |
|---|---|---|---|---|
| 6,577,736 | B1 | 6/2003 | Clemow | |
| 6,839,438 | B1 | 1/2005 | Riegelsberger | |
| 7,231,054 | B1 * | 6/2007 | Jot | H04S 3/00 381/18 |
| 7,263,193 | B2 | 8/2007 | Abel | |
| 7,634,092 | B2 | 12/2009 | McGrath | |
| 8,867,750 | B2 | 10/2014 | Brown | |
| 2007/0263888 | A1 * | 11/2007 | Melanson | H04S 3/00 381/300 |
| 2012/0232910 | A1 * | 9/2012 | Dressler | H04S 3/02 704/500 |
| 2014/0133683 | A1 | 5/2014 | Robinson | |

FOREIGN PATENT DOCUMENTS

| | | | | |
|---|---|---|---|---|
| DE | 3201455 | | 7/1983 | |
| EP | 1014756 | A2 * | 6/2000 | H04S 5/00 |
| JP | 2000-125399 | | 4/2000 | |
| JP | 2005-064746 | | 3/2005 | |
| JP | 2007-228526 | | 9/2007 | |
| JP | 2010-258653 | | 11/2010 | |
| JP | 2012-151530 | | 8/2012 | |
| JP | 2013-538509 | | 10/2013 | |
| JP | 2013-539286 | | 10/2013 | |
| JP | 2015-530825 | | 10/2015 | |
| RS | 1332 | U | 8/2013 | |
| WO | 2008/135049 | | 11/2008 | |

OTHER PUBLICATIONS

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

Gardner, William G. "3-D Audio Using Loudspeakers" The Springer International Series in Engineering and Computer Science, 1998.

Brown, P. et al "A Structural Model for Binaural Sound Synthesis" IEEE Transactions on Speech and Audio Processing, vol. 6, No. 5, Sep. 1998, pp. 476-488.

CIPIC HRTF Database, Release 1.1, Oct. 21, 2001; http://interface.cipic.ucdavis.edu/.

Tsakostas, C. et al "Optimized Binaural Modeling for Immersive Audio Applications" AES presented at the 122nd Convention May 5-8, 2007, Vienna, Austria, pp. 1-7.

* cited by examiner

VIRTUAL RENDERING OF OBJECT-BASED AUDIO

CROSS-REFERENCE TO RELATED APPLICATIONS

This application claims priority U.S. provisional priority application No. 61/695,944 filed 31 Aug. 2013, which is hereby incorporated by reference in its entirety.

FIELD OF THE INVENTION

One or more implementations relate generally to audio signal processing, and more specifically to virtual rendering and equalization of object-based audio.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Virtual rendering of spatial audio over a pair of speakers commonly involves the creation of a stereo binaural signal, which is then fed through a cross-talk canceller to generate left and right speaker signals. The binaural signal represents the desired sound arriving at the listener's left and right ears and is synthesized to simulate a particular audio scene in three-dimensional (3D) space, containing possibly a multitude of sources at different locations. The crosstalk canceller attempts to eliminate or reduce the natural crosstalk inherent in stereo loudspeaker playback so that the left channel of the binaural signal is delivered substantially to the left ear only of the listener and the right channel to the right ear only, thereby preserving the intention of the binaural signal. Through such rendering, audio objects are placed "virtually" in 3D space since a loudspeaker is not necessarily physically located at the point from which a rendered sound appears to emanate.

The design of the cross-talk canceller is based on a model of audio transmission from the speakers to a listener's ears. FIG. 1 illustrates a model of audio transmission for a cross-talk canceller system, as presently known. Signals $s_L$ and $s_R$ represent the signals sent from the left and right speakers 104 and 106, and signals $e_L$ and $e_R$ represent the signals arriving at the left and right ears of the listener 102. Each ear signal is modeled as the sum of the left and right speaker signals, and each speaker signal is filtered by a separate linear time-invariant transfer function H modeling the acoustic transmission from each speaker to that ear. These four transfer functions 108 are usually modeled using head related transfer functions (HRTFs) selected as a function of an assumed speaker placement with respect to the listener 102. In general, an HRTF is a response that characterizes how an ear receives a sound from a point in space; a pair of HRTFs for two ears can be used to synthesize a binaural sound that seems to emanate from a particular point in space.

The model depicted in FIG. 1 can be written in matrix equation form as follows:

$$\begin{bmatrix} e_L \\ e_R \end{bmatrix} = \begin{bmatrix} H_{LL} & H_{RL} \\ H_{LR} & H_{RR} \end{bmatrix} \begin{bmatrix} s_L \\ s_R \end{bmatrix} \text{ or } e = Hs \tag{1}$$

Equation 1 reflects the relationship between signals at one particular frequency and is meant to apply to the entire frequency range of interest, and the same applies to all subsequent related equations. A crosstalk canceller matrix C may be realized by inverting the matrix H, as shown in Equation 2:

$$C = H^{-1} = \frac{1}{H_{LL}H_{RR} - H_{LR}H_{RL}} \begin{bmatrix} H_{RR} & -H_{RL} \\ -H_{LR} & H_{LL} \end{bmatrix} \tag{2}$$

Given left and right binaural signals $b_L$ and $b_R$, the speaker signals $s_L$ and $s_R$ are computed as the binaural signals multiplied by the crosstalk canceller matrix:

$$s = Cb \text{ where } b = \begin{bmatrix} b_L \\ b_R \end{bmatrix} \tag{3}$$

Substituting Equation 3 into Equation 1 and noting that $C=H^{-1}$ yields:

$$e=HCb=b \tag{4}$$

In other words, generating speaker signals by applying the crosstalk canceller to the binaural signal yields signals at the ears of the listener equal to the binaural signal. This assumes that the matrix H perfectly models the physical acoustic transmission of audio from the speakers to the listener's ears. In reality, this will likely not be the case, and therefore Equation 4 will generally be approximated. In practice, however, this approximation is usually close enough that a listener will substantially perceive the spatial impression intended by the binaural signal b.

The binaural signal b is often synthesized from a monaural audio object signal o through the application of binaural rendering filters $B_L$ and $B_R$:

$$\begin{bmatrix} b_L \\ b_R \end{bmatrix} = \begin{bmatrix} B_L \\ B_R \end{bmatrix} o \text{ or } b = Bo \tag{5}$$

The rendering filter pair B is most often given by a pair of HRTFs chosen to impart the impression of the object signal o emanating from an associated position in space relative to the listener. In equation form, this relationship may be represented as:

$$B=HRTF\{\text{pos}(o)\} \tag{6}$$

In Equation 6 above, pos(o) represents the desired position of object signal o in 3D space relative to the listener. This position may be represented in Cartesian (x,y,z) coordinates or any other equivalent coordinate system such a polar system. This position might also be varying in time in order to simulate movement of the object through space. The function HRTF{ } is meant to represent a set of HRTFs addressable by position. Many such sets measured from human subjects in a laboratory exist, such as the CIPIC database, which is a public-domain database of high-spatial-resolution HRTF measurements for a number of different subjects. Alternatively, the set might be comprised of a parametric model such as the spherical head model. In a practical implementation, the HRTFs used for constructing the crosstalk canceller are often chosen from the same set used to generate the binaural signal, though this is not a requirement.

In many applications, a multitude of objects at various positions in space are simultaneously rendered. In such a case, the binaural signal is given by a sum of object signals with their associated HRTFs applied:

$$b = \sum_{i=1}^{N} B_i o_i \text{ where } B_i = HRTF\{pos(o_i)\} \tag{7}$$

With this multi-object binaural signal, the entire rendering chain to generate the speaker signals is given by:

$$s = C\sum_{i=1}^{N} B_i o_i \tag{8}$$

In many applications, the object signals $o_i$ are given by the individual channels of a multichannel signal, such as a 5.1 signal comprised of left, center, right, left surround, and right surround. In this case, the HRTFs associated with each object may be chosen to correspond to the fixed speaker positions associated with each channel. In this way, a 5.1 surround system may be virtualized over a set of stereo loudspeakers. In other applications the objects may be sources allowed to move freely anywhere in 3D space. In the case of a next generation spatial audio format, the set of objects in Equation 8 may consist of both freely moving objects and fixed channels.

One disadvantage of a virtual spatial audio rendering processor is that the effect is highly dependent on the listener sitting in the optimal position with respect to the speakers that is assumed in the design of the crosstalk canceller. What is needed, therefore, is a virtual rendering system and process that maintains the spatial impression intended by the binaural signal even if a listener is not placed in the optimal listening location.

BRIEF SUMMARY OF EMBODIMENTS

Embodiments are described for systems and methods of virtual rendering object-based audio content and improved equalization for crosstalk cancellers. The virtualizer involves the virtual rendering of object-based audio through binaural rendering of each object followed by panning of the resulting stereo binaural signal between a multitude of cross-talk cancelation circuits feeding a corresponding plurality of speaker pairs. In comparison to prior art virtual rendering utilizing a single pair of speakers, the method and system describe herein improves the spatial impression for both listeners inside and outside of the cross-talk canceller sweet spot.

A virtual spatial rendering method is extended to multiple pairs of speakers by panning the binaural signal generated from each audio object between multiple crosstalk cancellers. The panning between crosstalk cancellers is controlled by the position associated with each audio object, the same position utilized for selecting the binaural filter pair associated with each object. The multiple crosstalk cancellers are designed for and feed into a corresponding plurality of speaker pairs, each with a different physical location and/or orientation with respect to the intended listening position.

Embodiments also include an improved equalization process for a crosstalk canceller that is computed from both the crosstalk canceller filters and the binaural filters applied to a monophonic audio signal being virtualized. The equalization process results in improved timbre for listeners outside of the sweet spot as well as a smaller timbre shift when switching from standard rendering to virtual rendering.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Systems and methods are described for virtual rendering of objected-based object over multiple pairs of speakers, and an improved equalization scheme for such virtual rendering, though applications are not so limited. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Figure 1:
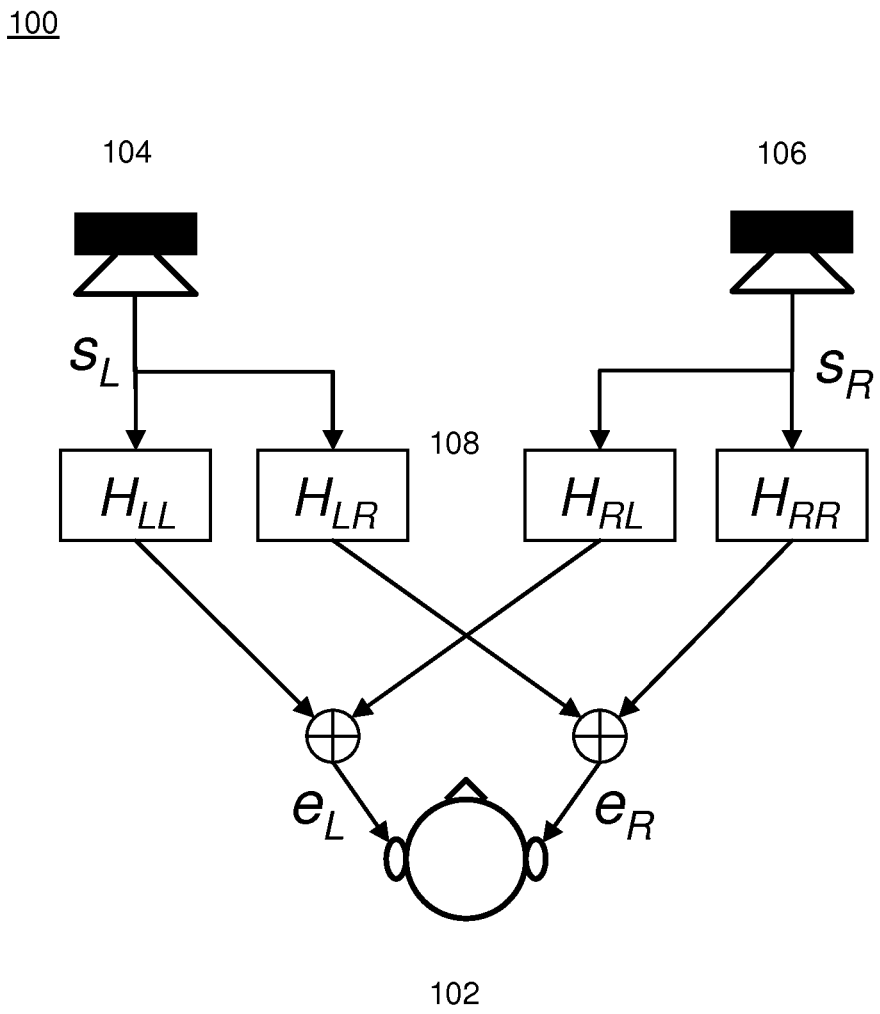
FIG. 1 (Prior Art)
FIG. 1 illustrates a cross-talk canceller system, as presently known.
Figure 2:
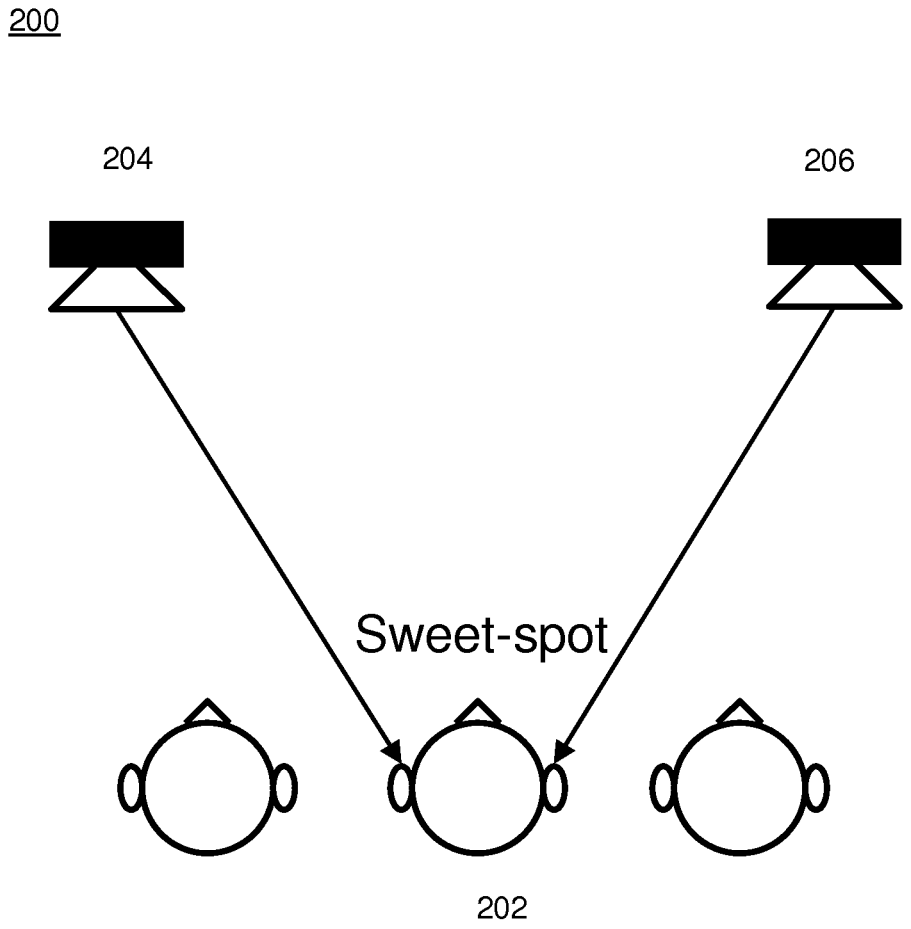
FIG. 2 illustrates an example of three listeners placed relative to an optimal position for virtual spatial rendering.

Embodiments are meant to address a general limitation of known virtual audio rendering processes with regard to the fact that the effect is highly dependent on the listener being located in the position with respect to the speakers that is assumed in the design of the crosstalk canceller. If the listener is not in this optimal listening location (the so-called "sweet spot"), then the crosstalk cancellation effect may be compromised, either partially or totally, and the spatial impression intended by the binaural signal is not perceived by the listener. This is particularly problematic for multiple listeners in which case only one of the listeners can effectively occupy the sweet spot. For example, with three listeners sitting on a couch, as depicted in FIG. 2, only the center listener 202 of the three will likely enjoy the full benefits of the virtual spatial rendering played back by speakers 204 and 206, since only that listener is in the crosstalk canceller's sweet spot. Embodiments are thus directed to improving the experience for listeners outside of the optimal location while at the same time maintaining or possibly enhancing the experience for the listener in the optimal location.

Diagram 200 illustrates the creation of a sweet spot location 202 as generated with a crosstalk canceller. It should be noted that application of the crosstalk canceller to the binaural signal described by Equation 3 and of the binaural filters to the object signals described by Equations 5 and 7 may be implemented directly as matrix multiplication in the frequency domain. However, equivalent application may be achieved in the time domain through convolution with appropriate FIR (finite impulse response) or IIR (infinite impulse response) filters arranged in a variety of topologies. Embodiments include all such variations.

In spatial audio reproduction, the sweet spot 202 may be extended to more than one listener by utilizing more than two speakers. This is most often achieved by surrounding a larger sweet spot with more than two speakers, as with a 5.1 surround system. In such systems, sounds intended to be heard from behind the listener(s), for example, are generated by speakers physically located behind them, and as such, all of the listeners perceive these sounds as coming from behind. With virtual spatial rendering over stereo speakers, on the other hand, perception of audio from behind is controlled by the HRTFs used to generated the binaural signal and will only be perceived properly by the listener in the sweet spot 202. Listeners outside of the sweet spot will likely perceive the audio as emanating from the stereo speakers in front of them. Despite their benefits, installation of such surround systems is not practical for many consumers. In certain cases, consumers may prefer to keep all speakers located at the front of the listening environment, oftentimes collocated with a television display. In other cases, space or equipment availability may be constrained.

Embodiments are directed to the use of multiple speaker pairs in conjunction with virtual spatial rendering in a way that combines benefits of using more than two speakers for listeners outside of the sweet spot and maintaining or enhancing the experience for listeners inside of the sweet spot in a manner that allows all utilized speaker pairs to be substantially collocated, though such collocation is not required. A virtual spatial rendering method is extended to multiple pairs of loudspeakers by panning the binaural signal generated from each audio object between multiple crosstalk cancellers. The panning between crosstalk cancellers is controlled by the position associated with each audio object, the same position utilized for selecting the binaural filter pair associated with each object. The multiple crosstalk cancellers are designed for and feed into a corresponding multitude of speaker pairs, each with a different physical location and/or orientation with respect to the intended listening position.

As described above, with a multi-object binaural signal, the entire rendering chain to generate speaker signals is given by the summation expression of Equation 8. The expression may be described by the following extension of Equation 8 to M pairs of speakers:

$$s_j = C_j \sum_{i=1}^{N} \alpha_{ij} B_i o_i,\ j = 1 \ldots M,\ M > 1 \tag{9}$$

In the above equation 9, the variables have the following assignments:

$o_i$=audio signal for the ith object out of N $B_i$=binaural filter pair for the ith object given by $B_i$=HRTF{pos($o_i$)}

$\alpha_{ij}$=panning coefficient for the ith object into the jth crosstalk canceller $C_j$=crosstalk canceller matrix for the jth speaker pair $s_j$=stereo speaker signal sent to the jth speaker pair The M panning coefficients associated with each object i are computed using a panning function which takes as input the possibly time-varying position of the object:

$$\begin{bmatrix} \alpha_{1i} \\ \vdots \\ \alpha_{Mi} \end{bmatrix} = Panner\{pos(o_i)\} \tag{10}$$

Figure 3:
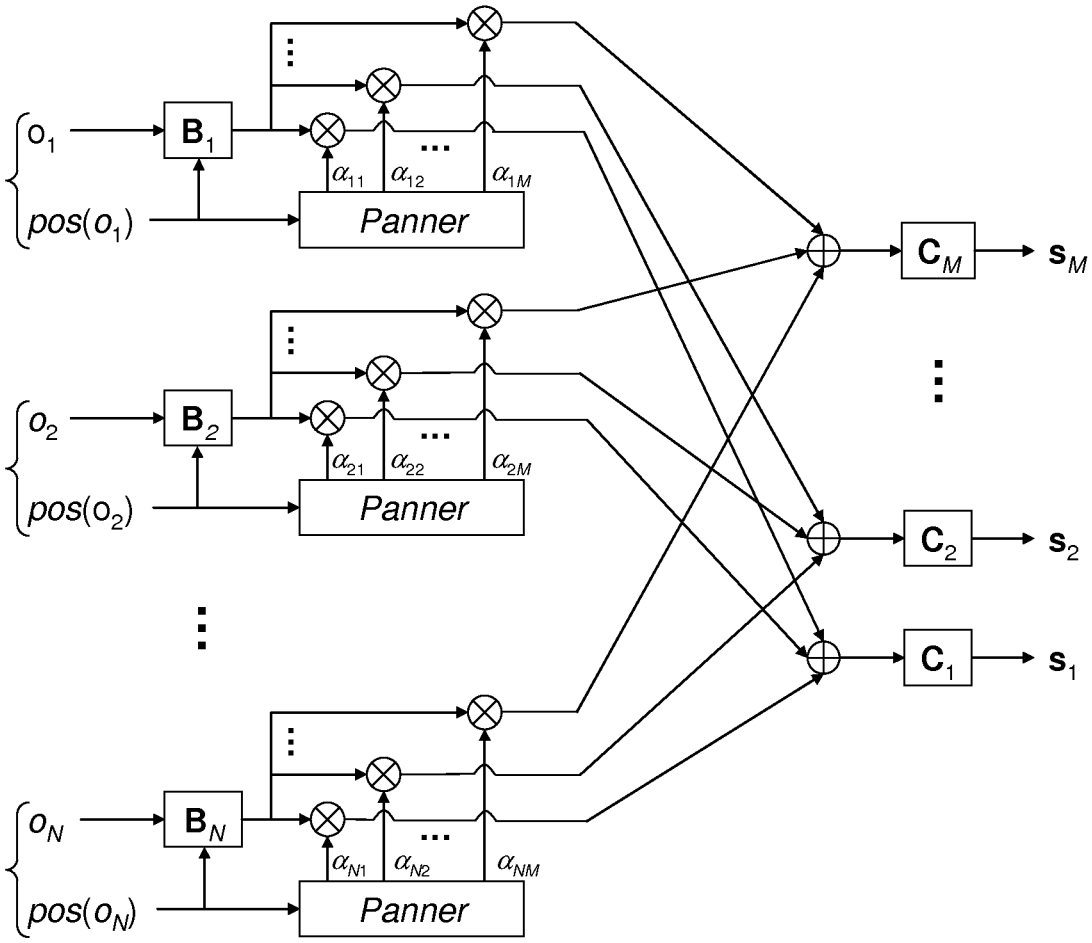
FIG. 3 is a block diagram of a system for panning a binaural signal generated from audio objects between multiple crosstalk cancellers, under an embodiment.
Figure 4:
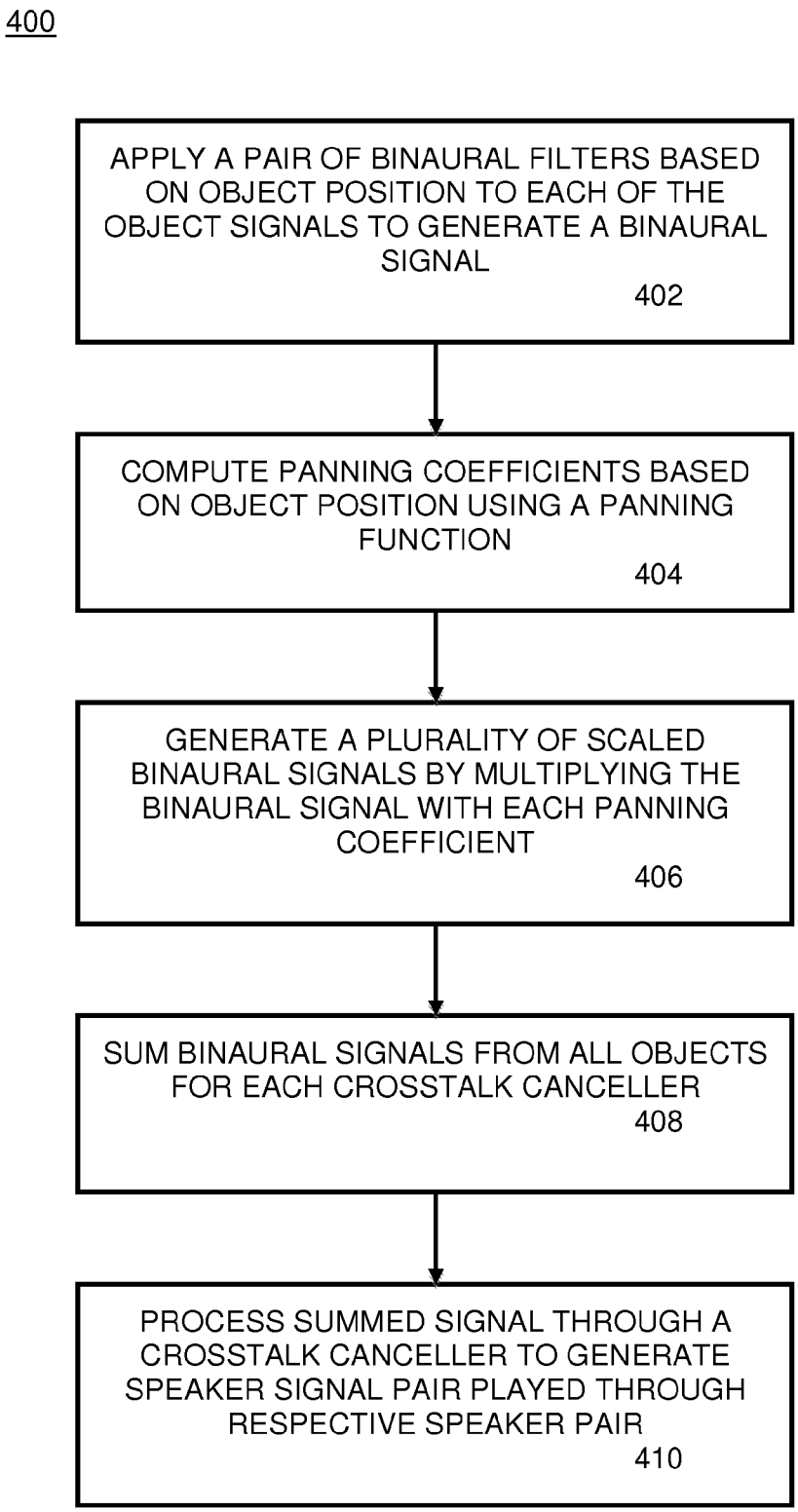
FIG. 4 is a flowchart that illustrates a method of panning the binaural signal between the multiple crosstalk cancellers, under an embodiment.

Equations 9 and 10 are equivalently represented by the block diagram depicted in FIG. 3. FIG. 3 illustrates a system for panning a binaural signal generated from audio objects between multiple crosstalk cancellers, and FIG. 4 is a flowchart that illustrates a method of panning the binaural signal between the multiple crosstalk cancellers, under an embodiment. As shown in diagrams 300 and 400, for each of the N object signals $o_i$, a pair of binaural filters $B_i$, selected as a function of the object position pos($o_i$), is first applied to generate a binaural signal, step 402. Simultaneously, a panning function computes M panning coefficients, $a_{i1} \ldots a_{iM}$, based on the object position pos($o_i$), step 404. Each panning coefficient separately multiplies the binaural signal generating M scaled binaural signals, step 406. For each of the M crosstalk cancellers, $C_j$, the jth scaled binaural signals from all N objects are summed, step 408. This summed signal is then processed by the crosstalk canceller to generate the jth speaker signal pair $s_j$, which is played back through the jth loudspeaker pair, step 410. It should be noted that the order of steps illustrated in FIG. 4 is not strictly fixed to the sequence shown, and some of the illustrated steps or acts may be performed before or after other steps in a sequence different to that of process 400.

In order to extend the benefits of the multiple loudspeaker pairs to listeners outside of the sweet spot, the panning function distributes the object signals to speaker pairs in a manner that helps convey desired physical position of the object (as intended by the mixer or content creator) to these listeners. For example, if the object is meant to be heard from overhead, then the panner pans the object to the speaker pair that most effectively reproduces a sense of height for all listeners. If the object is meant to be heard to the side, the panner pans the object to the pair of speakers that most effectively reproduces a sense of width for all listeners. More generally, the panning function compares the desired spatial position of each object with the spatial reproduction capabilities of each speaker pair in order to compute an optimal set of panning coefficients.

Figure 5:
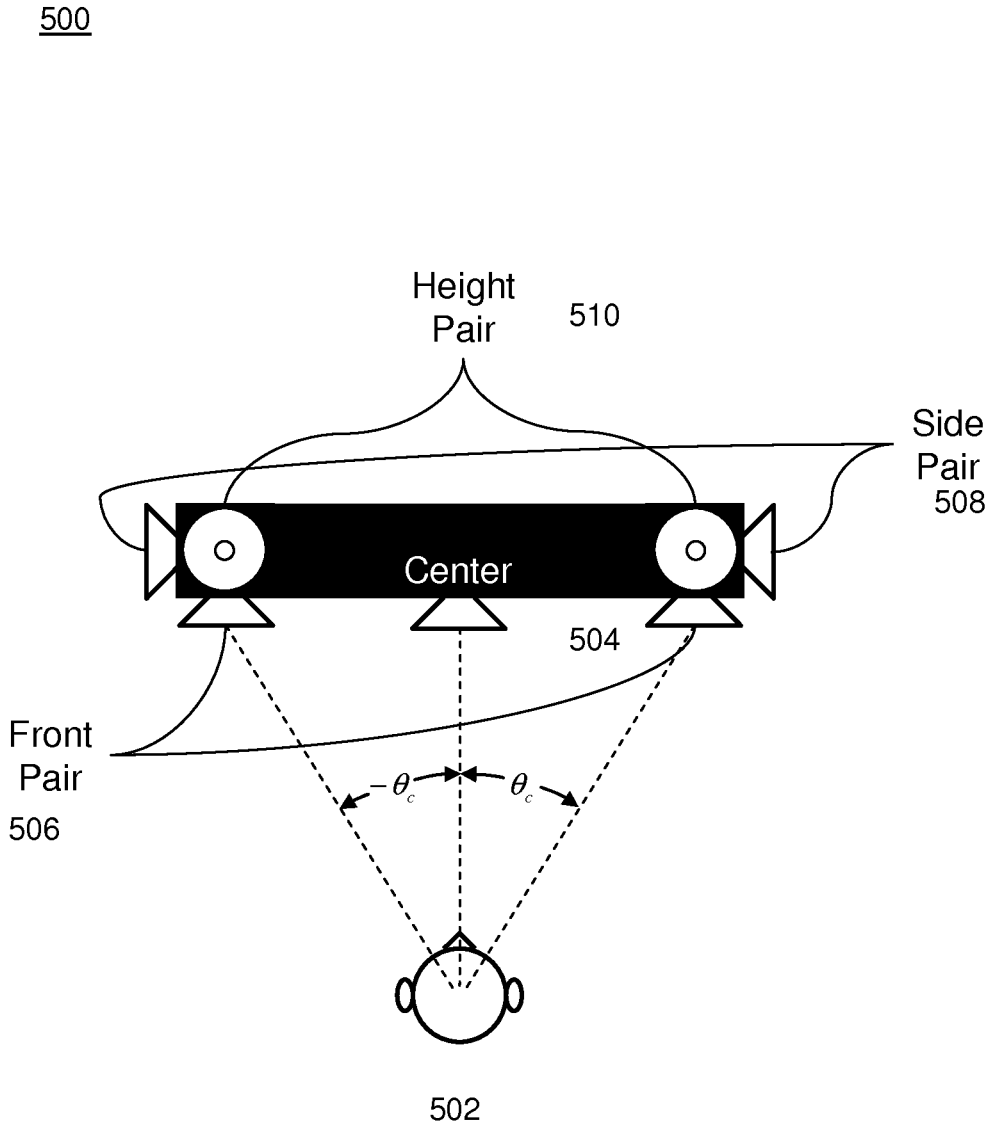
FIG. 5 illustrates an array of speaker pairs that may be used with a virtual rendering system, under an embodiment.

In general, any practical number of speaker pairs may be used in any appropriate array. In a typical implementation, three speaker pairs may be utilized in an array that are all collocated in front of the listener as shown in FIG. 5. As shown in diagram 500, a listener 502 is placed in a location relative to speaker array 504. The array comprises a number of drivers that project sound in a particular direction relative to an axis of the array. For example, as shown in FIG. 5, a first driver pair 506 points to the front toward the listener (front-firing drivers), a second pair 508 points to the side (side-firing drivers), and a third pair 510 points upward (upward-firing drivers). These pairs are labeled, Front 506, Side 508, and Height 510 and associated with each are cross-talk cancellers $C_F$, $C_S$, and $C_H$, respectively.

For both the generation of the cross-talk cancellers associated with each of the speaker pairs, as well as the binaural filters for each audio object, parametric spherical head model HRTFs are utilized. In an embodiment, such parametric spherical head model HRTFs may be generated as described in U.S. patent application Ser. No. 13/132,570 (Publication No. US 2011/0243338) entitled "Surround Sound Virtualizer and Method with Dynamic Range Compression," which is hereby incorporated by reference and attached hereto as Appendix 1. In general, these HRTFs are dependent only on the angle of an object with respect to the median plane of the listener. As shown in FIG. 5, the angle at this median plane is defined to be zero degrees with angles to the left defined as negative and angles to the right as positive.

For the speaker layout shown in FIG. 5, it is assumed that the speaker angle $\theta_C$ is the same for all three speaker pairs, and therefore the crosstalk canceller matrix C is the same for all three pairs. If each pair was not at approximately the same position, the angle could be set differently for each pair. Letting $HRTF_L\{\theta\}$ and $HRTF_R\{\theta\}$ define the left and right parametric HRTF filters associated with an audio source at angle θ, the four elements of the cross-talk canceller matrix as defined in Equation 2 are given by:

$$H_{LL}=HRTF_L\{-\theta_C\} \tag{11a}$$

$$H_{LR}=HRTF_R\{-\theta_C\} \tag{11b}$$

$$H_{RL}=HRTF_L\{\theta_C\} \tag{11c}$$

$$H_{RR}=HRTF_R\{\theta_C\} \tag{11d}$$

Associated with each audio object signal $o_i$ is a possibly time-varying position given in Cartesian coordinates $\{x_i\ y_i\ z_i\}$. Since the parametric HRTFs employed in the preferred embodiment do not contain any elevation cues, only the x and y coordinates of the object position are utilized in computing the binaural filter pair from the HRTF function. These $\{x_i\ y_i\}$ coordinates are transformed into equivalent radius and angle $\{r_i\ \theta_i\}$, where the radius is normalized to lie between zero and one. In an embodiment, the parametric HRTF does not depend on distance from the listener, and therefore the radius is incorporated into computation of the left and right binaural filters as follows:

$$B_L=(1-\sqrt{r_i})+\sqrt{r_i}HRTF_L\{\theta_i\} \tag{12a}$$

$$B_R=(1-\sqrt{r_i})+\sqrt{r_i}HRTF_R\{\theta_i\} \tag{12b}$$

When the radius is zero, the binaural filters are simply unity across all frequencies, and the listener hears the object signal equally at both ears. This corresponds to the case when the object position is located exactly within the listener's head. When the radius is one, the filters are equal to the parametric HRTFs defined at angle $\theta_i$. Taking the square root of the radius term biases this interpolation of the filters toward the HRTF that better preserves spatial information. Note that this computation is needed because the parametric HRTF model does not incorporate distance cues. A different HRTF set might incorporate such cues in which case the interpolation described by Equations 12a and 12b would not be necessary.

For each object, the panning coefficients for each of the three crosstalk cancellers are computed from the object position $\{x_i\ y_i\ z_i\}$ relative to the orientation of each canceller. The upward firing speaker pair 510 is meant to convey sounds from above by reflecting sound off of the ceiling or other upper surface of the listening environment. As such, its associated panning coefficient is proportional to the elevation coordinate $z_i$. The panning coefficients of the front and side firing pairs are governed by the object angle $\theta_i$, derived from the $\{x_i\ y_i\}$ coordinates. When the absolute value of $\theta_i$ is less that 30 degrees, object is panned entirely to the front pair 506. When the absolute value of $\theta_i$ is between 30 and 90 degrees, the object is panned between the front and side pairs 506 and 508; and when the absolute value of $\theta_i$ is greater than 90 degrees, the object is panned entirely to the side pair 508. With this panning algorithm, a listener in the sweet spot 502 receives the benefits of all three cross-talk cancellers. In addition, the perception of elevation is added with the upward-firing pair, and the side-firing pair adds an element of diffuseness for objects mixed to the side and back, which can enhance perceived envelopment. For listeners outside of the sweet-spot, the cancellers lose much of their effectiveness, but these listeners still get the perception of elevation from the upward-firing pair and the variation between direct and diffuse sound from the front to side panning.

As shown in diagram 400, an embodiment of the method involves computing panning coefficients based on object position using a panning function, step 404. Letting $\alpha_{iF}$, $\alpha_{iS}$, and $\alpha_{iH}$ represent the panning coefficients of the ith object into the Front, Side, and Height crosstalk cancellers, an algorithm for the computation of these panning coefficients is given by:

$$\alpha_{iH} = \sqrt{z_i} \tag{13a}$$

if $\text{abs}(\theta_i) < 30$, $$\alpha_{iF} = \sqrt{(1-\alpha_{iH}^2)} \tag{13b}$$

$$\alpha_{iS} = 0 \tag{13c}$$

else if $\text{abs}(\theta_i) < 90$, $$\alpha_{iF} = \sqrt{(1-\alpha_{iH}^2)\frac{\text{abs}(\theta_i)-90}{30-90}} \tag{13d}$$

-continued $$\alpha_{iS} = \sqrt{(1-\alpha_{iH}^2)\frac{\mathrm{abs}(\theta_i)-30}{90-30}} \tag{13e}$$

else, $$\alpha_{iF} = 0 \tag{13f}$$

$$\alpha_{iS} = \sqrt{(1-\alpha_{iH}^2)} \tag{13g}$$

It should be noted that the above algorithm maintains the power of every object signal as it is panned. This maintenance of power can be expressed as:

$$\alpha_{iF}^2+\alpha_{iS}^2+\alpha_{iH}^2=1 \tag{13h}$$

In an embodiment, the virtualizer method and system using panning and cross correlation may be applied to a next generation spatial audio format as which contains a mixture of dynamic object signals along with fixed channel signals. Such a system may correspond to a spatial audio system as described in pending U.S. Provisional Patent Application 61/636,429, filed on Apr. 20, 2012 and entitled "System and Method for Adaptive Audio Signal Generation, Coding and Rendering," which is hereby incorporated by reference, and attached hereto as Appendix 2. In an implementation using surround-sound arrays, the fixed channels signals may be processed with the above algorithm by assigning a fixed spatial position to each channel. In the case of a seven channel signal consisting of Left, Right, Center, Left Surround, Right Surround, Left Height, and Right Height, the following {r θ z} coordinates may be assumed:

Left: {1, −30, 0}
Right: {1, 30, 0}
Center: {1, 0, 0}
Left Surround: {1, −90, 0}
Right Surround: {1, 90, 0}
Left Height {1, −30, 1}
Right Height {1, 30, 1}

As shown in FIG. 5, a preferred speaker layout may also contain a single discrete center speaker. In this case, the center channel may be routed directly to the center speaker rather than being processed by the circuit of FIG. 4. In the case that a purely channel-based legacy signal is rendered by the preferred embodiment, all of the elements in system 400 are constant across time since each object position is static. In this case, all of these elements may be pre-computed once at the startup of the system. In addition, the binaural filters, panning coefficients, and crosstalk cancellers may be pre-combined into M pairs of fixed filters for each fixed object.

Although embodiments have been described with respect to a collocated driver array with Front/Side/Upward firing drivers, any practical number of other embodiments are also possible. For example, the side pair of speakers may be excluded, leaving only the front facing and upward facing speakers. Also, the upward-firing pair may be replaced with a pair of speakers placed near the ceiling above the front facing pair and pointed directly at the listener. This configuration may also be extended to a multitude of speaker pairs spaced from bottom to top, for example, along the sides of a screen.

Equalization for Virtual Rendering

Embodiments are also directed to an improved equalization for a crosstalk canceller that is computed from both the crosstalk canceller filters and the binaural filters applied to a monophonic audio signal being virtualized. The result is improved timbre for listeners outside of the sweet-spot as well as a smaller timbre shift when switching from standard rendering to virtual rendering.

As stated above, in certain implementations, the virtual rendering effect is often highly dependent on the listener sitting in the position with respect to the speakers that is assumed in the design of the crosstalk canceller. For example, if the listener is not sitting in the right sweet spot, the crosstalk cancellation effect may be compromised, either partially or totally. In this case, the spatial impression intended by the binaural signal is not fully perceived by the listener. In addition, listeners outside of the sweet spot may often complain that the timbre of the resulting audio is unnatural.

To address this issue with timbre, various equalizations of the crosstalk canceller in Equation 2 have been proposed with the goal of making the perceived timbre of the binaural signal b more natural for all listeners, regardless of their position. Such an equalization may be added to the computation of the speaker signals according to:

$$s=ECb \tag{14}$$

In the above Equation 14, E is a single equalization filter applied to both the left and right speakers signals. To examine such equalization, Equation 2 can be rearranged into the following form:

$$C = \begin{bmatrix} EQF_L & 0 \\ 0 & EQF_R \end{bmatrix}\begin{bmatrix} 1 & -ITF_R \\ -ITF_L & 1 \end{bmatrix}, \tag{15}$$

where $$ITF_L = \frac{H_{LR}}{H_{LL}},\ ITF_R = \frac{H_{RL}}{H_{RR}},\ EQF_L = \frac{\frac{1}{H_{LL}}}{1-ITF_L ITF_R},\ \text{and}$$

$$EQF_R = \frac{\frac{1}{H_{RR}}}{1-ITF_L ITF_R}$$

If the listener is assumed to be placed symmetrically between the two speakers, then $ITF_L=ITF_R$ and $EQF_L=EQF_R$, and Equation 6 reduces to:

$$C = EQF\begin{bmatrix} 1 & -ITF \\ -ITF & 1 \end{bmatrix} \tag{16}$$

Based on this formulation of the cross-talk canceller, several equalization filters E may be used. For example, in the case that the binaural signal is mono (left and right signals are equal), the following filter may be used:

$$E = \frac{1}{EQF(1-ITF)} \tag{17}$$

An alternative filter for the case that the two channels of the binaural signal are statistically independent may be expressed as:

$$E = \sqrt{\frac{1}{|EQF|^2(1+|ITF|^2)}} \tag{18}$$

Such equalization may provide benefits with respect to the perceived timbre of the binaural signal b. However, the binaural signal b is oftentimes synthesized from a monaural audio object signal o through the application of binaural rendering filters $B_L$ and $B_R$:

$$\begin{bmatrix} b_L \\ b_R \end{bmatrix} = \begin{bmatrix} B_L \\ B_R \end{bmatrix} o \text{ or } b = Bo \tag{19}$$

The rendering filter pair B is most often given by a pair of HRTFs chosen to impart the impression of the object signal o emanating from an associated position in space relative to the listener. In equation form, this relationship may be represented as:

$$B = HRTF\{\text{pos}(o)\} \tag{20}$$

In this equation, pos(o) represents the desired position of object signal o in 3D space relative to the listener. This position may be represented in Cartesian (x,y,z) coordinates or any other equivalent coordinate system such a polar. This position might also be varying in time in order to simulate movement of the object through space. The function HRTF{ } is meant to represent a set of HRTFs addressable by position. Many such sets measured from human subjects in a laboratory exist, such as the CIPIC database. Alternatively, the set might be comprised of a parametric model such as the spherical head model mentioned previously. In a practical implementation, the HRTFs used for constructing the crosstalk canceller are often chosen from the same set used to generate the binaural signal, though this is not a requirement.

Substituting Equation 19 into 14 gives the equalized speaker signals computed from the object signal according to:

$$s = ECBo \tag{21}$$

In many virtual spatial rendering systems, the user is able to switch from a standard rendering of the audio signal o to a binauralized, cross-talk cancelled rendering employing Equation 21. In such a case, a timbre shift may result from both the application of the crosstalk canceller C and the binauralization filters B, and such a shift may be perceived by a listener as unnatural. An equalization filter E computed solely from the crosstalk canceller, as exemplified by Equations 17 and 18, is not capable of eliminating this timbre shift since it does not take into account the binauralization filters. Embodiments are directed to an equalization filter that eliminates or reduces this timbre shift.

It should be noted that application of the equalization filter and crosstalk canceller to the binaural signal described by Equation 14 and of the binaural filters to the object signal described by Equation 19 may be implemented directly as matrix multiplication in the frequency domain. However, equivalent application may be achieved in the time domain through convolution with appropriate FIR (finite impulse response) or IIR (infinite impulse response) filters arranged in a variety of topologies. Embodiments apply generally to all such variations.

In order to design an improved equalization filter, it is useful to expand Equation 21 into its component left and right speaker signals:

$$\begin{bmatrix} s_L \\ s_R \end{bmatrix} = E \begin{bmatrix} EQF_L & 0 \\ 0 & EQF_R \end{bmatrix} \begin{bmatrix} 1 & -ITF_R \\ -ITF_L & 1 \end{bmatrix} \begin{bmatrix} B_L \\ B_R \end{bmatrix} o = E \begin{bmatrix} R_L \\ R_R \end{bmatrix} o \tag{22a}$$

where $$R_L = (EQF_L)(B_L - B_R ITF_R) \tag{22b}$$

$$R_R = (EQF_R)(B_R - B_L ITF_L) \tag{22c}$$

In the above equations, the speaker signals can be expressed as left and right rendering filters $R_L$ and $R_R$ followed by equalization E applied to the object signal o. Each of these rendering filters is a function of both the crosstalk canceller C and binaural filters B as seen in Equations 22b and 22c. A process computes an equalization filter E as a function of these two rendering filters $R_L$ and $R_R$ with the goal achieving natural timbre, regardless of a listener's position relative to the speakers, along with timbre that is substantially the same when the audio signal is rendered without virtualization.

At any particular frequency, the mixing of the object signal into the left and right speaker signals may be expressed generally as $$\begin{bmatrix} s_L \\ s_R \end{bmatrix} = \begin{bmatrix} \alpha_L \\ \alpha_R \end{bmatrix} o \tag{23}$$

In the above Equation 23, $\alpha_L$ and $\alpha_R$ are mixing coefficients, which may vary over frequency. The manner in which the object signal is mixed into the left and right speakers signals for non-virtual rendering may therefore be described by Equation 23. Experimentally it has been found that the perceived timbre, or spectral balance, of the object signal o is well modeled by the combined power of the left and right speaker signals. This holds over a wide listening area around the two loudspeakers. From Equation 23, the combined power of the non-virtualized speaker signals is given by:

$$P_{NV} = (|\alpha_L|^2 + |\alpha_R|^2)|o|^2 \tag{24}$$

From Equations 13, the combined power of the virtualized speaker signals is given by $$P_V = |E|^2(|R_L|^2 + |R_R|^2)|o|^2 \tag{25}$$

The optimum equalization filter $E_{opt}$ is found by setting $P_V = P_{NV}$ and solving for E:

$$E_{opt} = \frac{|\alpha_L|^2 + |\alpha_R|^2}{|R_L|^2 + |R_R|^2} \tag{26}$$

The equalization filter $E_{opt}$ in Equation 26 provides timbre for the virtualized rendering that is consistent across a wide listening area and substantially the same as that for non-virtualized rendering. It can be seen that $E_{opt}$ is computed as a function of the rendering filters $R_L$ and $R_R$ which are in turn a function of both the crosstalk canceller C and the binauralization filters B.

In many cases, mixing of the object signal into the left and right speakers for non-virtual rendering will adhere to a power preserving panning law, meaning that the equivalence of Equation 27 below holds for all frequencies.

$$|\alpha_L|^2 + |\alpha_R|^2 = 1 \tag{27}$$

In this case the equalization filter simplifies to:

$$E_{opt} = \frac{1}{|R_L|^2 + |R_R|^2} \tag{28}$$

With the utilization of this filter, the sum of the power spectra of the left and right speaker signals is equal to the power spectrum of the object signal.

Figure 6:
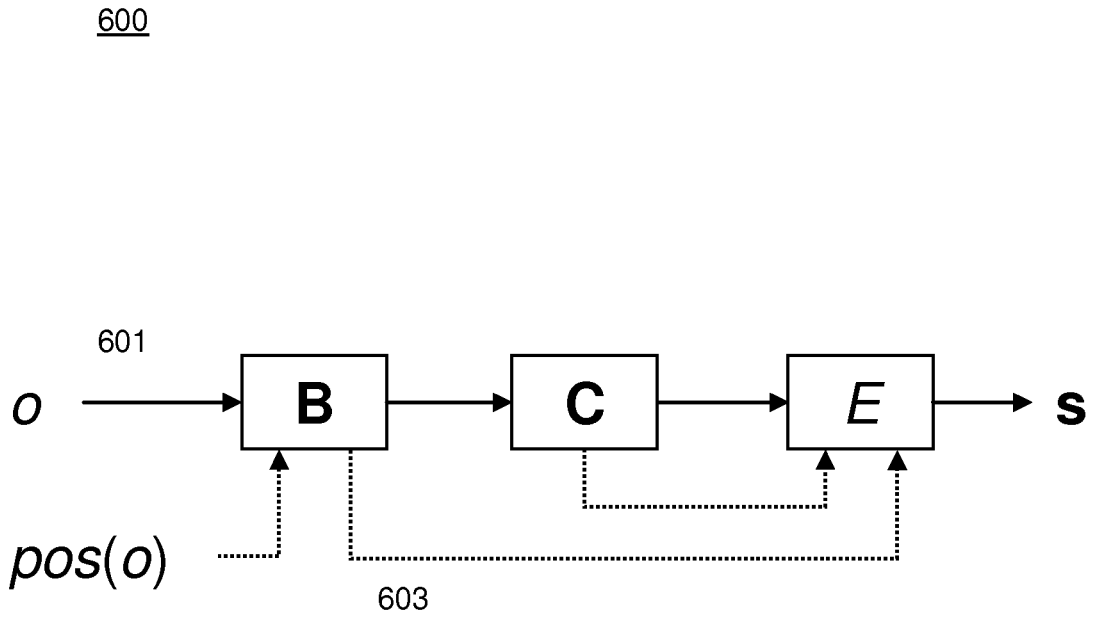
FIG. 6 is a diagram that depicts an equalization process applied for a single object o, under an embodiment.
Figure 7:
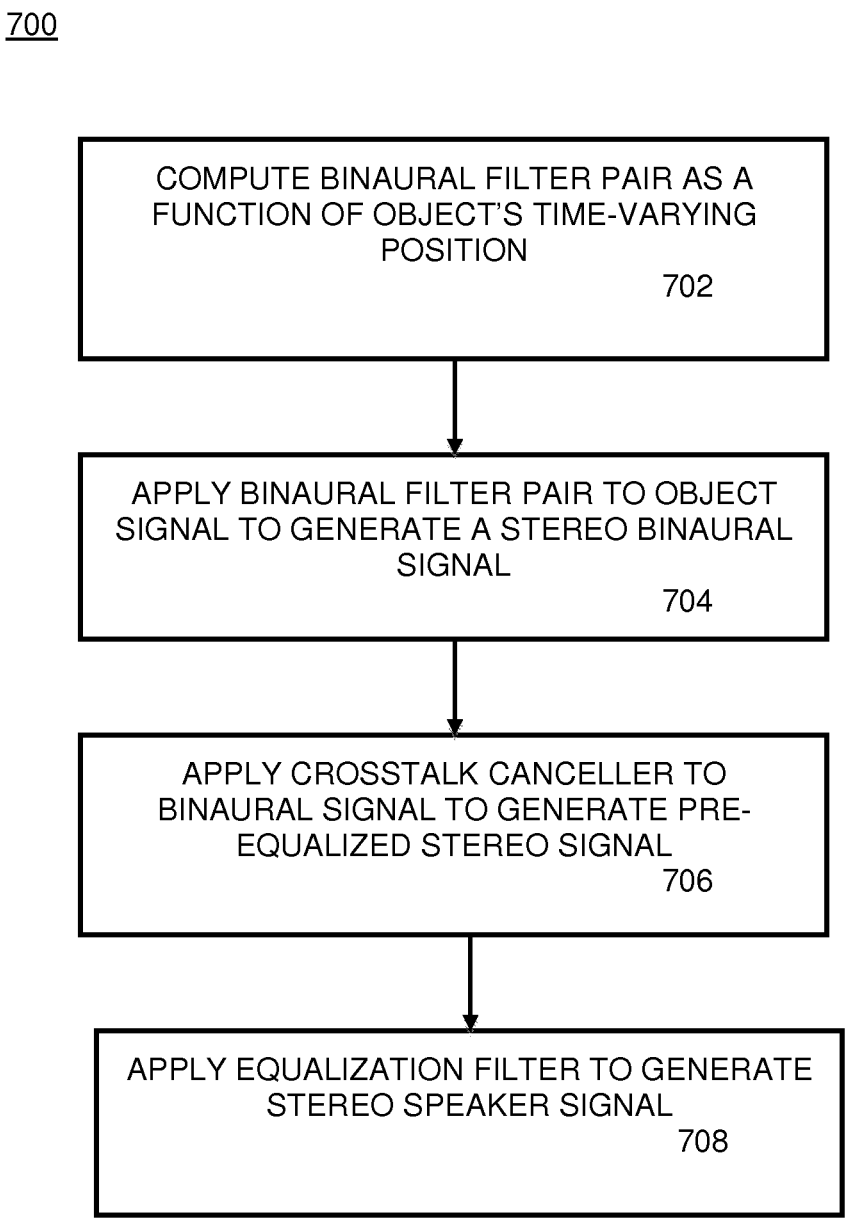
FIG. 7 is a flowchart that illustrates a method of performing the equalization process for a single object, under an embodiment.

FIG. 6 is a diagram that depicts an equalization process applied for a single object o, under an embodiment, and FIG. 7 is a flowchart that illustrates a method of performing the equalization process for a single object, under an embodiment. As shown in diagram 700, the binaural filter pair B is first computed as a function of the object's possibly time varying position, step 702, and then applied to the object signal to generate a stereo binaural signal, step 704. Next, as shown in step 706, the crosstalk canceller C is applied to the binaural signal to generate a pre-equalized stereo signal. Finally, the equalization filter E is applied to generate the stereo loudspeaker signal s, step 708. The equalization filter may be computed as a function of both the crosstalk canceller C and binaural filter pair B. If the object position is time varying, then the binaural filters will vary over time, meaning that the equalization E filter will also vary over time. It should be noted that the order of steps illustrated in FIG. 7 is not strictly fixed to the sequence shown. For example, the equalizer filter process 708 may applied before or after the crosstalk canceller process 706. It should also be noted that, as shown in FIG. 6, the solid lines 601 are meant to depict audio signal flow, while the dashed lines 603 are meant to represent parameter flow, where the parameters are those associated with the HRTF function.

In many applications, a multitude of audio object signals placed at various, possibly time-varying positions in space are simultaneously rendered. In such a case, the binaural signal is given by a sum of object signals with their associated HRTFs applied:

$$b = \sum_{i=1}^{N} B_i o_i \tag{29}$$

where $$B_i = HRTF\{pos(o_i)\}$$

With this multi-object binaural signal, the entire rendering chain to generate the speaker signals, including the inventive equalization, is given by:

$$s = C\sum_{i=1}^{N} E_i B_i o_i \tag{30}$$

In comparison to the single-object Equation 21, the equalization filter has been moved ahead of the crosstalk canceller. By doing this, the cross-talk, which is common to all component object signals, may be pulled out of the sum. Each equalization filter $E_i$, on the other hand, is unique to each object since it is dependent on each object's binaural filter $B_i$.

Figure 8:
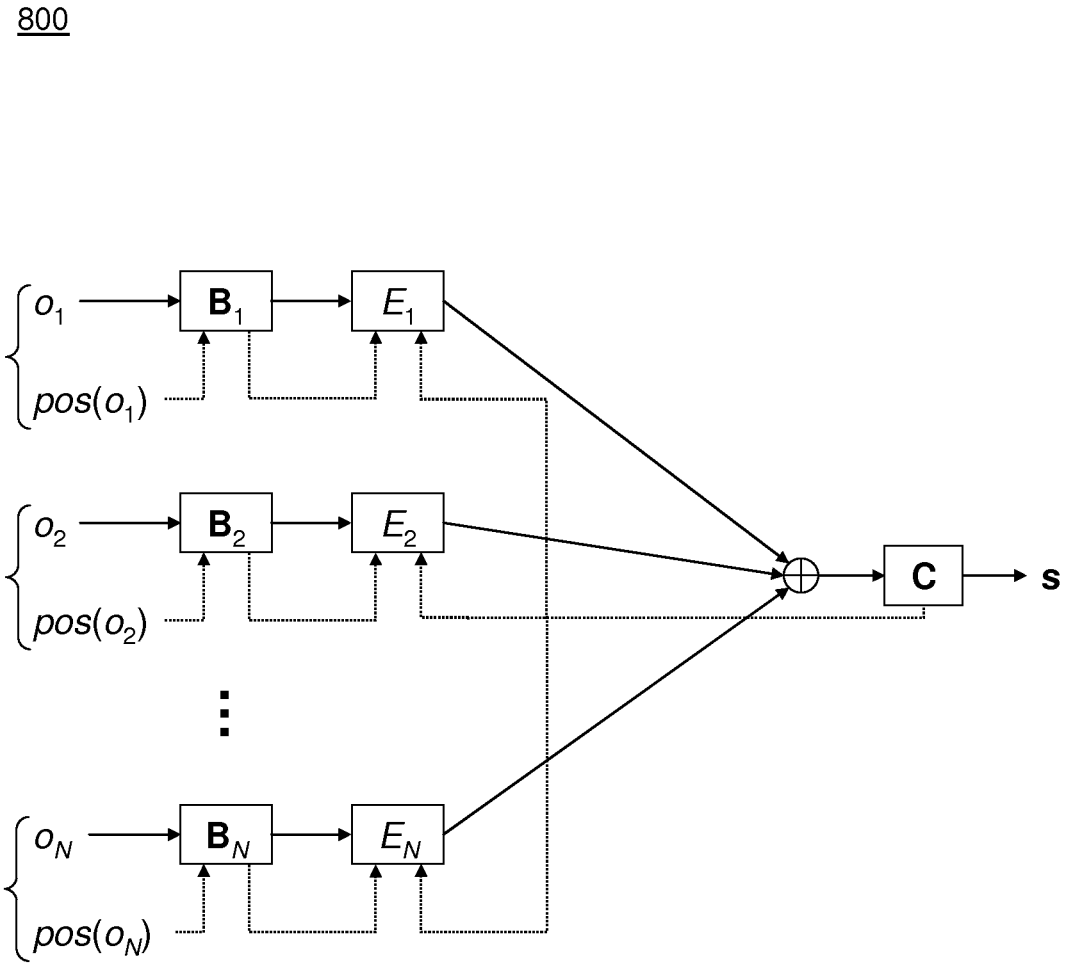
FIG. 8 is a block diagram of a system applying an equalization process to multiple objects, under an embodiment.

FIG. 8 is a block diagram 800 of a system applying an equalization process simultaneously to multiple objects input through the same cross-talk canceller, under an embodiment. In many applications, the object signals $o_i$ are given by the individual channels of a multichannel signal, such as a 5.1 signal comprised of left, center, right, left surround, and right surround. In this case, the HRTFs associated with each object may be chosen to correspond to the fixed speaker positions associated with each channel. In this way, a 5.1 surround system may be virtualized over a set of stereo loudspeakers. In other applications the objects may be sources allowed to move freely anywhere in 3D space. In the case of a next generation spatial audio format, the set of objects in Equation 30 may consist of both freely moving objects and fixed channels.

Figure 9:
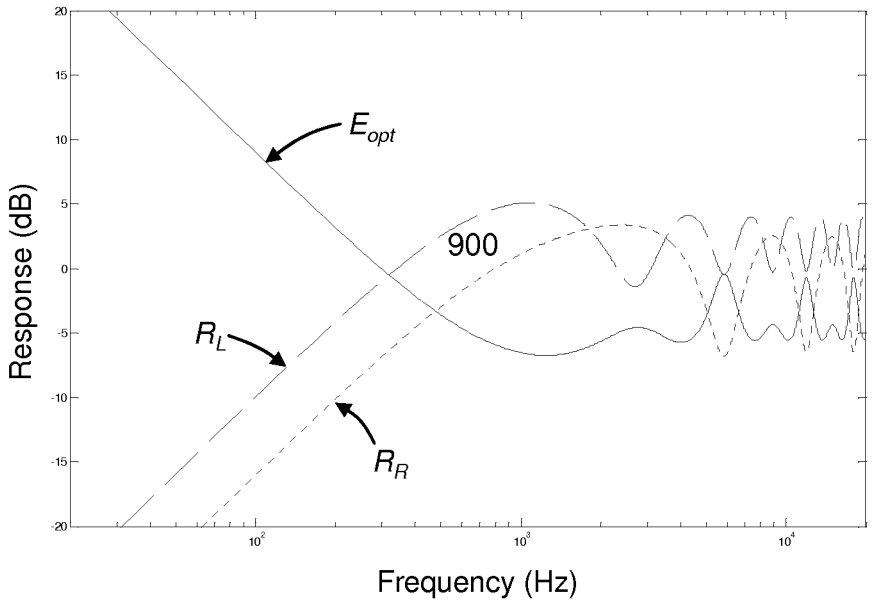
FIG. 9 is a graph that depicts a frequency response for rendering filters, under a first embodiment.
Figure 10:
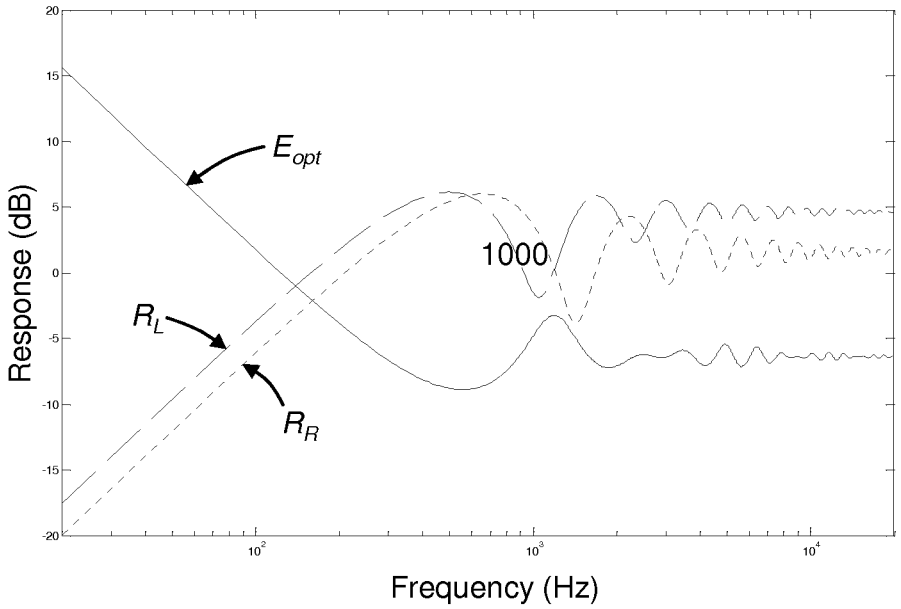
FIG. 10 is a graph that depicts a frequency response for rendering filters, under a second embodiment.

In an embodiment, the cross-talk canceller and binaural filters are based on a parametric spherical head model HRTF. Such an HRTF is parametrized by the azimuth angle of an object relative to the median plane of the listener. The angle at the median plane is defined to be zero with angles to the left being negative and angles to the right being positive. Given this particular formulation of the cross-talk canceller and binaural filters, the optimal equalization filter $E_{opt}$ is computed according to Equation 28. FIG. 9 is a graph that depicts a frequency response for rendering filters, under a first embodiment. As shown in FIG. 9, plot 900 depicts the magnitude frequency response of the rendering filters $R_L$ and $R_R$ and the resulting equalization filter $E_{opt}$ corresponding to a physical speaker separation angle of 20 degrees and a virtual object position of −30 degrees. Different responses may be obtained for different speaker separation configurations. FIG. 10 is a graph that depicts a frequency response for rendering filters, under a second embodiment. FIG. 10 depicts a plot 1000 for a physical speaker separation of 20 degrees and a virtual object position of −30 degrees.

Aspects of the virtualization and equalization techniques described herein represent aspects of a system for playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. Embodiments may be applied in a home theater environment in which the spatial audio content is associated with television content, it should be noted that embodiments may also be implemented in other consumer-based systems. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A method for virtually rendering object-based audio comprising:

applying an object signal and a corresponding object signal position to a binaural filter pair to generate a binaural signal, wherein the object signal and the object signal position are associated with an audio object of the object-based audio;

multiplying the binaural signal by panning coefficients computed based on the object signal position to generate scaled binaural signals;

panning the binaural signal generated from the binaural filter pair to a plurality of crosstalk cancellers, wherein the panning to crosstalk cancellers is controlled by a position associated with each audio object;

summing the scaled binaural signals together; and applying a cross-talk cancellation process to the summed scaled binaural signals to generate a speaker signal pair for playback through a speaker.

2. The method of claim 1 wherein the binaural filter pair utilizes a pair of head related transfer functions (HRTFs) of a desired position of the object signal in three-dimensional space relative to a listener in the listening area.

3. The method of claim 1 wherein the object-based audio includes legacy content configured for playback in a surround system comprising a speaker array disposed in a defined surround sound configuration, and wherein fixed channel positions of the legacy content comprise respective objects of the object signal.

4. The method of claim 1 wherein the object signal is a time-varying signal and the object signal has associated therewith a position in three-dimensional space.

5. The method of claim 1 wherein a pair of binaural filter functions is applied to the object signal based on the position associated an audio object.

6. The method claim 1 wherein the speaker is a soundbar with a pair of side-firing drivers.

7. The method claim 1 wherein the speaker is a soundbar with a pair of upward-firing drivers.

8. The method claim 1 wherein the speaker is a soundbar with a pair of front-firing drivers.

9. A system for virtually rendering object-based audio through a plurality of speaker pairs in a listening environment, comprising:

a receiver stage receiving a plurality of object signals;

a plurality of binaural filters configured to apply a pair of binaural filter functions to each object signal of one or more object signals to generate a respective binaural signal, wherein at least a portion of the object signals comprise time-varying objects, and wherein each binaural filter is selected as a function of object position of a respective object signal;

a plurality of panning circuits configured to compute a plurality of panning coefficients for each object signal based on the object position, wherein each panning coefficient of the plurality of panning coefficients is multiplied by the respective binaural signal to generate a plurality of scaled binaural signals;

a plurality of summer circuits configured to sum together corresponding scaled binaural signals for each panning coefficient of the plurality of panning coefficients to generate a plurality of summed signals; and a plurality of crosstalk canceller circuits each applying a crosstalk cancellation process to each summed signal of the plurality of summed signals to generate a speaker signal pair for output through a respective speaker pair.

10. The system of claim 9 wherein each of the pair of binaural filters utilizes one of a pair of head related transfer functions (HRTFs) of a desired position of the object signal in three-dimensional space relative to a listener in the listening area.

11. The system of claim 9 wherein each panning circuit implements a panning function configured to distribute each object signal of the plurality of object signals to each speaker pair of the plurality of speaker pairs in a manner that conveys a desired position of each respective object signal to each listener of a plurality of listeners in the listening area.

12. The system of claim 10 wherein the desired position of the object signal comprises a location perceptively above the listener, and wherein the object signal is played back by one of a speaker physically placed above the listener, and an upward-firing driver configured to project sound waves toward a ceiling of the listening area for reflection down to the listener.

13. The system of claim 9 wherein the speaker is a soundbar with a pair of side-firing drivers.

14. The system of claim 9 wherein the speaker is a soundbar with a pair of upward-firing drivers.

15. The system of claim 9 wherein the speaker is a soundbar with a pair of front-firing drivers.

* * * * *